United States Patent [19]

Flipse et al.

[11] Patent Number: 4,996,023

[45] Date of Patent: Feb. 26, 1991

[54] METHOD OF MANUFACTURING A PERMANENT MAGNET

[75] Inventors: Abraham R. Flipse; Peter J. Kay, both of Eindhoven, Netherlands; Ewoud Rozendaal, Southport, Great Britain

[73] Assignee: U.S. Philips Corp., New York, N.Y.

[21] Appl. No.: 421,863

[22] Filed: Oct. 16, 1989

[30] Foreign Application Priority Data

Oct. 17, 1988 [NL] Netherlands ..... 8802543

[51] Int. Cl.[5] ..... B22F 1/00

[52] U.S. Cl. ..... 419/12; 419/23; 419/33; 419/38; 75/246; 252/62.55

[58] Field of Search ..... 419/12, 23, 33, 38; 252/62.55; 75/246

[56] References Cited

U.S. PATENT DOCUMENTS

| | | | |
|---|---|---|---|
| 4,765,848 | 9/1988 | Mohri et al. | 148/302 |
| 4,814,139 | 3/1989 | Tokunaga et al. | 419/12 |
| 4,826,546 | 5/1989 | Yamamoto et al. | 148/102 |
| 4,836,868 | 6/1989 | Yajima et al. | 148/302 |
| 4,859,410 | 8/1989 | Brewer | 419/10 |
| 4,867,809 | 9/1989 | Haverstick | 148/101 |
| 4,881,985 | 11/1989 | Brewer | 148/103 |
| 4,898,625 | 2/1990 | Otsuka et al. | 148/101 |

*Primary Examiner*—Stephen J. Lechert, Jr.
*Assistant Examiner*—Nina Bhat
*Attorney, Agent, or Firm*—William J. Botjer

[57] ABSTRACT

The invention describes a method of manufacturing a magnet on the basis of $Re_2Fe_{14}B$. To this end, a shaped body of the said composition is sintered by means of induction heating to a density exceeding 95% of the theoretical maximum density. The method according to the invention enables the manufacture of magnets having excellent properties in a very short time, these properties being: a high energy product, a large remanence, a high density, a large intrinsic coercive force and a small particle size.

8 Claims, 2 Drawing Sheets

METHOD OF MANUFACTURING A PERMANENT MAGNET

BACKGROUND OF THE INVENTION

The invention relates to a method of manufacturing a permanent magnet which comprises a hard magnetic material having a tetragonal phase of the $RE_2Fe_{14}B$ type, wherein RE is at least one element selected from the group consisting of the rare earth metals having atomic number 57 up to and including 71 and Yttrium, the method comprising the following steps 1. forming an alloy comprising 8–30 at. % RE, 2–28 at. % B and 42–90 at. % Fe
2. pulverizing the alloy into a powder
3. compressing the powder, whether or not in a magnetic field, into a shaped body
4. sintering the shaped body in the temperature range from 900°–1200° C., after which the body may be magnetized.

Such a method is known from European Patent Application No. 153.744. In the method described therein, a powder of an alloy of the above composition and having an average particle size from 0.3–80 μm is compressed into a shaped body, after which this body is converted into an end-product by subjecting it to three heat treatments. These heat treatments successively comprise a sintering treatment (900°–1200° C., preferably for 0.5 to 4 hours), a first heat treatment (750°–1000° C., preferably for 0.5 to 8 hours) and a second heat treatment 480°–700° C., preferably for 0.5 to 12 hours). These heat treatments contribute to obtaining magnets having favourable hard magnetic properties such as a high density, a high remanence and a large energy product.

The well-known method has the disadvantage that the heat treatments take up a considerable amount of time. If mass production in a continuous process is pursued, the duration of the heat treatments is an insuperable problem from an economic point of view. In such a continuous process, magnets are individually formed by successively compressing a powder, sintering the shaped body obtained and inspecting it for mechanical and magnetic properties.

SUMMARY OF THE INVENTION

It is an object of the invention to provide a method which does not have the above-mentioned disadvantage. A further object of the invention is to provide a method by means of which magnets can be manufactured having a density (d) which exceeds 95% of the theoretically possible density. A still further object of the invention is to provide a method of manufacturing magnets consisting of a magnetic material having a small grain size. According to yet another aspect of the object, the invention aims at providing a method by means of which magnets having a large intrinsic coercive force ($_iH_c$) can be obtained. Another object of the invention is to provide a method of manufacturing magnets which have a hysteresis loop whose squareness ratio ($\psi$) is at least 85%. A further object of the invention is to provide a method by means of which magnets having a high remanence ($B_r$) and a large energy product ($BH_{max}$) can be manufactured.

These and other objects are attained by means of a method which is characterized according to the invention in that the shaped body is sintered to at least 95% of the theoretical maximum density by means of induction heating in a single sintering treatment.

It has been found that this method enables magnets having favourable magnetic properties to be manufactured rapidly or even very rapidly. For example, it has surprisingly been found that compressed shaped bodies of the $RE_2Fe_{14}B$ material can be sintered to substantially full density by means of induction heating within one minute (including the warming-up time during which the temperature increases from room temperature to sintering temperature), the intrinsic coercive force ($_iH_c$) being approximately 850 kA/m$^3$. The shaped bodies are induction-sintered in vacuum or in an atmosphere consisting of an inert gas (argon, helium, neon or mixtures thereof). In the sintering process the shaped bodies are warmed up in that the induction field generated by the generator couples with the sample to be sintered. To this end this sample is introduced into an induction coil. It has been found that the method according to the invention enables the production of magnets having remanence values ($B_r$) of 1.2 T and higher, and energy products of 280 kJ/m$^3$ and more. If desired, a small part of the Fe which is present may be replaced by another transition metal. If, for example, a high Curie temperature is pursued, it is favourable to replace a part of the Fe by Co when forming the alloy. If the composition comprises Dy, it is advisable to use also a small quantity of Nb. Although the exact mechanism is (so far) unknown, it is assumed that the high density is reached in such a short time due to, inter alia, "induction stirring" of the liquid phase present at the sintering temperature. This stirring-effect which is brought about by induction heating might be responsible, amongst others, for the fact that the pores of the material are dense-sintered very rapidly. It is also possible that due to "induction stirring" the phases, present in a liquid or non-liquid state in the sintered material are better and more rapidly mixed than in the case of the conventional sintering in a furnace.

Laboratory experiments carried out by Applicant, in which shaped bodies of the $Re_2Fe_{14}B$ material were sintered in a furnace in a manner analogous to that known from EP-A-153.744 showed that it takes at least 15 minutes to attain sintering densities of 95% and higher of the theoretical value. Optimum magnetic properties of shaped bodies sintered in this manner were attained only after longer sintering times. From the point of view of manufacturing costs such a long sintering time is undesirable.

A preferred embodiment of the method according to the invention is characterized in that the elements Nd and/or Dy are used as the rare earth metal (RE). The magnets manufactured using these rare earth metals in a method according to the invention are found to have the best properties.

Another preferred embodiment of the method according to the invention is characterized in that the sintering treatment lasts maximally ten minutes. If sintering is continued for longer than ten minutes, the grain growth leads to unacceptably large dimensions of the magnetic particles in the first place, and in the second place such a long sintering time is undesirable from the point of view of manufacturing costs. Grain growth, leading to an increase of the particle dimensions, has an adverse effect on the magnetic properties of magnetic material. Consequently, the aim is to manufacture magnets having magnetic particles whose dimensions are preferably smaller than 25 μm.

A further preferred embodiment of the method according to the invention is characterized in that the sintering treatment lasts maximally five minutes. It has been found, that the highest values of the intrinsic coercive force ($_iH_c$) are obtained when the shaped body is sintered for maximally five minutes.

A still further preferred embodiment of the invention is characterized in that the sintering treatment lasts minimally two minutes. It has been found that when the sintering time lasts less than two minutes, the remanence ($B_r$), the squareness ratio of the hysteresis loop ($\psi$) and the energy product ($BH_{max}$) of the sintered shaped bodies have not yet reached their optimum values.

A further preferred embodiment of the method according to the invention is characterized in that in the case of sintering the average warming-up rate exceeds 200 K/min.

It is to be noted that, after sintering, the shaped bodies can be cooled to room temperature within six minutes. Cooling may be carried out in vacuum or in a protective gas atmosphere. Subsequently, the magnetic and mechanical properties of the shaped body can be measured.

BRIEF DESCRIPTION OF THE DRAWINGS

The invention will be explained in greater detail by means of the following exemplary embodiments and with reference to the drawings, in which.

DETAILED DESCRIPTION OF THE PREFERRED EMBODIMENTS

EXAMPLES:

An alloy which is composed of 75 at. % Fe, 8 at. % B and 17 at. % Nd was obtained from the at least 99% pure constituent elements by means of arc melting. After cooling the alloy was ground under a nitrogen atmosphere using a hammer mill to obtain a powder having an average particle size of 0.5 mm. Subsequently, this powder was ground in toluene in a high-energy ball mill until an average particle size of 3.5 $\mu$m was obtained. The toluene was removed from the powder thus obtained by drying. Next, the dry powder was introduced into a cylindrical mould having a length of 3 cm and a diameter of 1 cm, pulsed in a magnetic field of 7 T and isostatically compressed into a shaped body at a pressure of at least 3 kBar. By means of induction heating (2 MHz generator having a power of 2 kW) the shaped bodies were sintered in a vacuum of approximately $10^{-2}$ mBar. In a number of experiments the average warming-up rate, the sintering time and the sintering temperature were varied. Preferably, the average warming-up rate exceeds 200 $Kmin.^{-1}$. After the sintering treatment, the sintered magnets were cooled in vacuum or in an argon atmosphere to room temperature within a few minutes. Subsequently, various magnetic and mechanical parameters were measured on the magnets.

TABLE 1

| Nr | d(%) | Br(T) | iHc ($kAm^{-1}$) | BHmax ($kJm^{-3}$) | $\phi$(%) | T(oC) | t(min) |
|---|---|---|---|---|---|---|---|
| 1 | 95.7 | 0.98 | 910 | 159 | — | 1000 | 1.5 |
| 2 | 99.2 | 1.13 | 830 | 225 | — | 1000 | 1.6 |
| 3 | 99.7 | 1.18 | 875 | 251 | — | 1050 | 0.7 |
| 4 | 99.3 | 1.22 | 820 | 284 | 87.8 | 1050 | 2.12 |
| 5 | 98.8 | 1.24 | 745 | 293 | 92.3 | 1050 | 4 |
| 6 | 99.7 | 1.21 | 780 | 275 | 96.2 | 1050 | 9 |
| 7 | 100.0 | 1.25 | 705 | 293 | 92.2 | 1050 | 8 |
| 8 | 100.0 | 1.24 | 745 | 285 | — | 1100 | 9 |
| 9 | 99.7 | 1.21 | 780 | 275 | — | 1100 | 9 |

Figure 1:
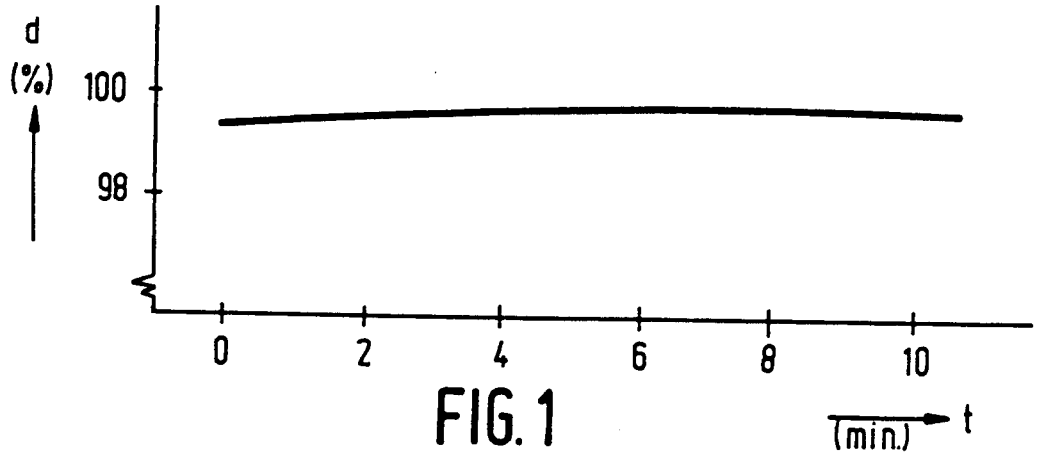
FIG. 1 shows the density (d) on a percentage basis of $Nd_2Fe_{14}B$ sintered according to the method of the invention, as a function of the sintering time (t in min.)
Figure 2:
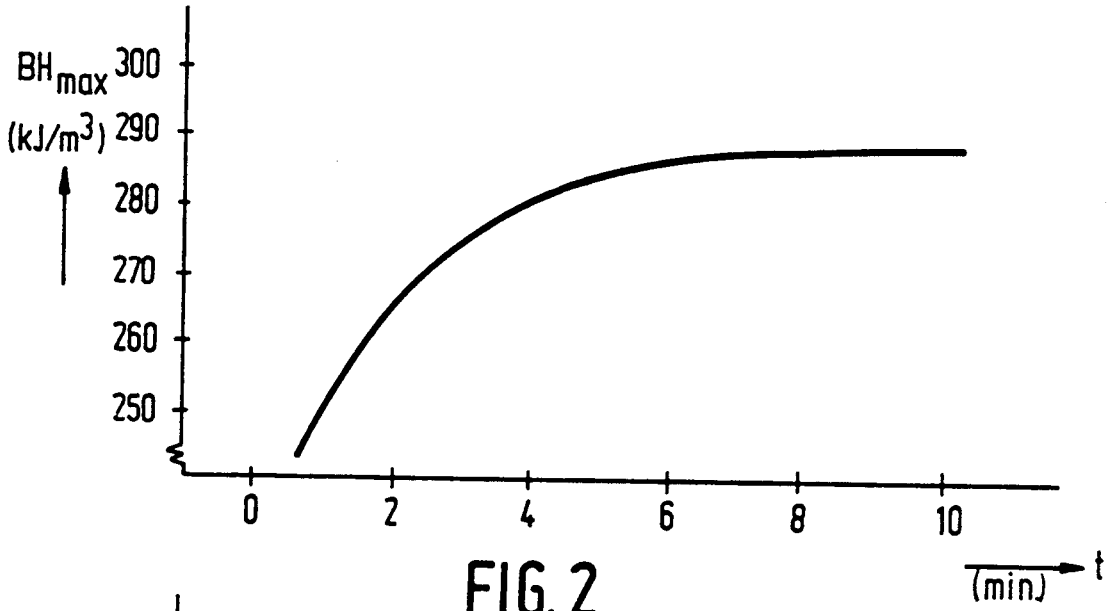
FIG. 2 shows the energy product ($BH_{max}$ in $kJm^{-3}$) of $Nd_2Fe_{14}B$ sintered according to the method of the invention, as a function of the sintering time (t in min.)
Figure 3:
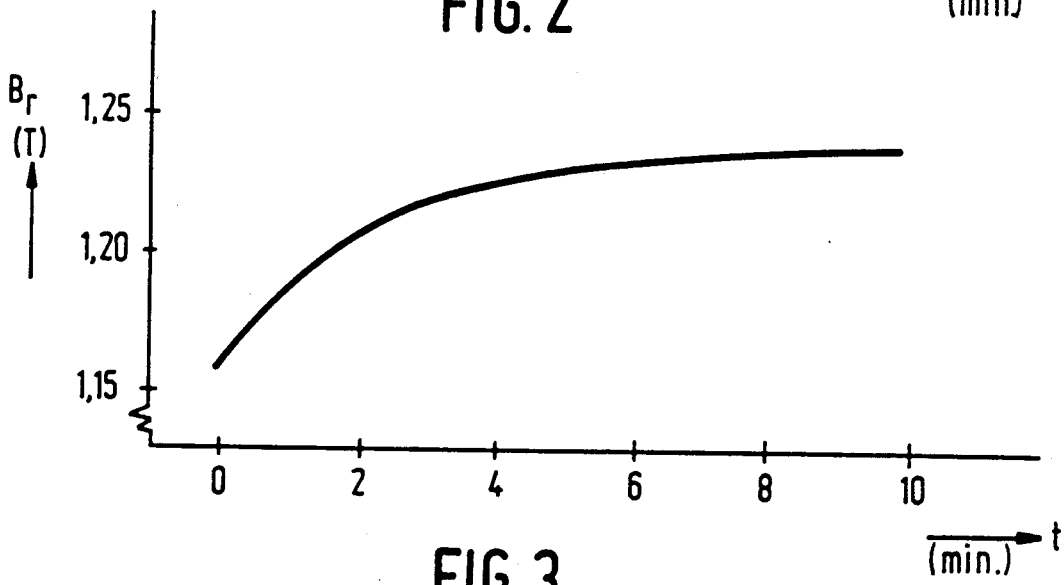
FIG. 3 shows the remanence ($B_r$ in T) of $Nd_2Fe_{14}B$ sintered according to the method of the invention, as a function of the sintering time (t in min.)
Figure 4:
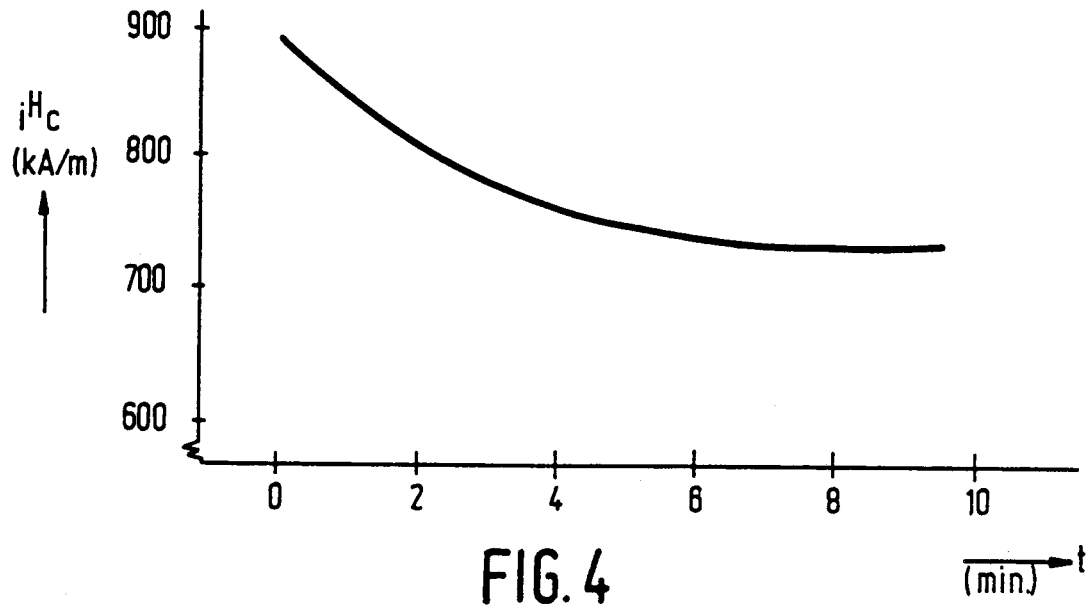
FIG. 4 shows the intrinsic coercive force ($_iH_c$ in $kAm^{-1}$) of $Nd_2Fe_{14}B$ sintered according to the method of the invention, as a function of the sintering time (t in min.)
Figure 5:
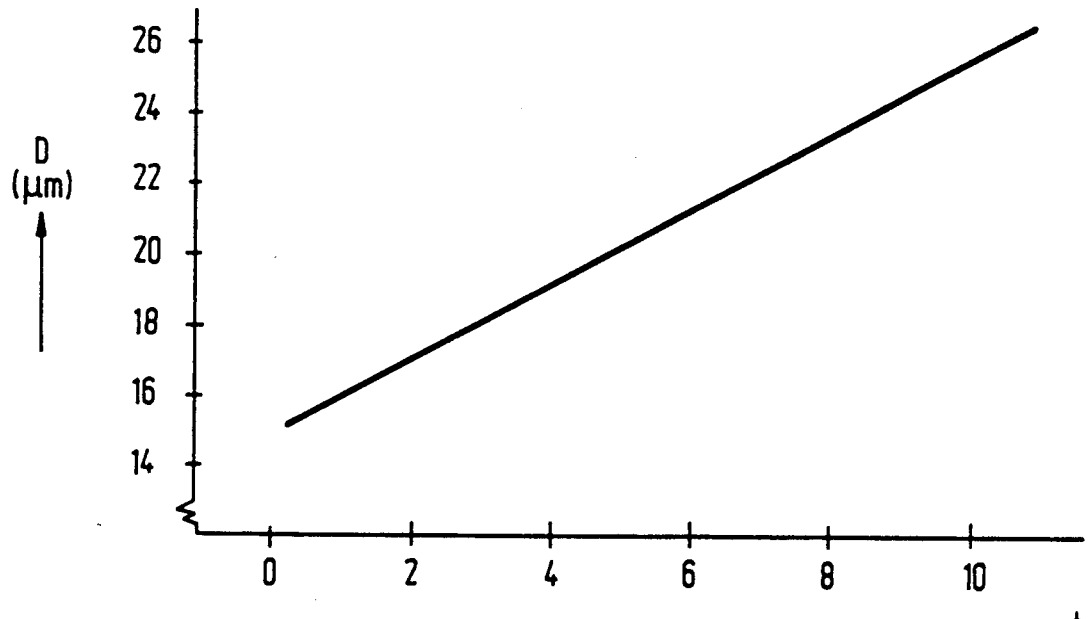
FIG. 5 shows the average grain size (D in $\mu$m) of $Nd_2Fe_{14}B$ sintered according to the method of the invention, as a function of the sintering time (t in min.)
Figure 6:
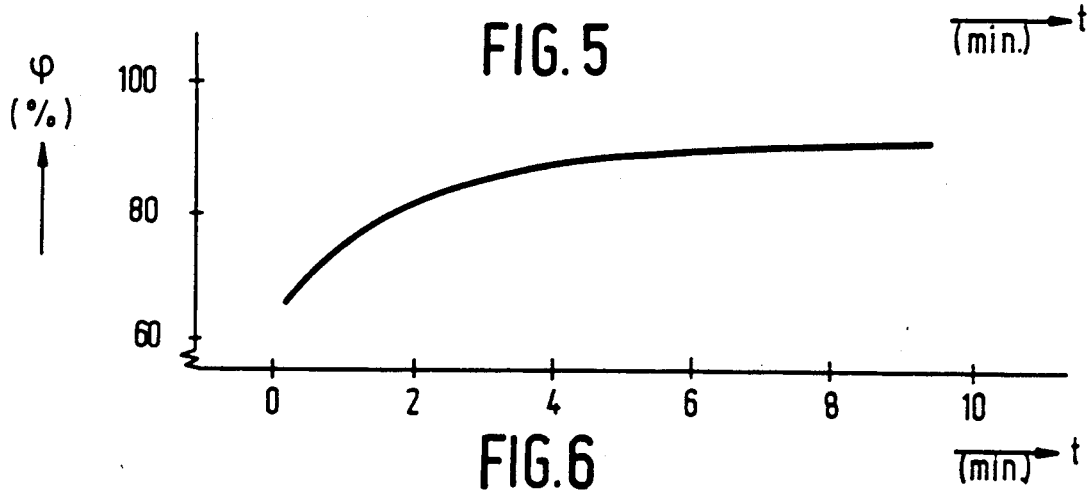
FIG. 6 shows the squareness ratio on a percentage basis of the hysteresis loop of the $Nd_2Fe_{14}B$ sintered according to the method of the invention, as a function of the sintering time (t in min.).

Table 1 lists the results of a number of representative $Nd_2Fe_{14}B$ sintering experiments according to the method of the invention. The FIGS. 1–6 illustrate the results of several tens of experiments carried out on $Nd_2Fe_{14}B$ shaped bodies which were sintered at 1050° C. It can be derived from the Table (nos. 3–7) and the Figures that irrespective of the sintering time a density of at least 95% of the theoretically attainable density is obtained under these circumstances (FIG. 1). It can further be derived that optimum values of remanence ($B_r$), energy product and squareness ratio of the hysteresis loop are attained after a sintering time of approximately 2 minutes (FIGS. 3, 2 and 6, respectively). It has also been found that the highest intrinsic coercive force ($_iH_c$) is attained at a sintering time of less than 5 minutes (FIG. 4).

In particular the drawings further show that a suitable choice of the sintering time, particularly in the time range from 0.5 min. to five min. enables magnets to be manufactured having a predetermined value of energy product and/or coercive force. Shaped bodies which are sintered for 0.5 to five minutes by means of the method according to the invention have a high coercive force and a sufficiently high energy product.

An alloy having a composition of 75.7 at. % Fe, 1.02 at. % Nb, 7.01 at. % B, 1.52 at. % Dy and 14.6 at. % Nd was obtained from the constituent elements by means of arc melting. The composition obtained was ground to a fine powder by means of an attritor mill. The powder was compressed to a cylindrically shaped body in a manner analogous to that described with reference to the above-mentioned Nd-Fe-B-shaped bodies. The shaped bodies (cross-section 5.4 mm, length 6.1 mm) were subsequently placed in an induction coil (cross-section 20 mm, length 40 mm) which was connected to an AC generator (2 MHz, 2 kW power), sintered in a vacuum by means of induction heating and then cooled. Table 2 lists a number of representative induction sintering experiments with the alloy comprising Nd/Dy.

TABLE 2

| Nr | d(%) | Br(T) | iHc($kAm^{-1}$) | BHmax ($kJm^{-3}$) | T(oC) | t(min) |
|---|---|---|---|---|---|---|
| 1 | 98.6 | 0.97 | 992 | 157 | 1025 | 1.35 |

TABLE 2-continued

| Nr | d(%) | Br(T) | iHc(kAm$^{-1}$) | BHmax (kJm$^{-3}$) | T(oC) | t(min) |
|---|---|---|---|---|---|---|
| 2 | 100.0 | 0.97 | 1045 | 156 | 1025 | 2.57 |

Table 2 again shows the surprisingly high density of the magnet obtained by means of the method according to the invention.

We claim:

1. A method of manufacturing a permanent magnet which comprises a hard magnetic material having a tetragonal phase of the $RE_2Fe_{14}B$ type, wherein RE is at least one element selected from the group consisting of the rare earth metals having atomic number 57 up to and including 71 and Yttrium, the method comprising the following steps (a) forming an alloy comprising 8–30 at. % RE, 2–28 at. % B and 42–90 at. % Fe (b) pulverizing the alloy into a powder (c) compressing the powder, into a shaped body, and (d) sintering the shaped body in the temperature range from 900°–1200° C., wherein the shaped body is sintered to at least 95% of the theoretical maximum density by means of induction heating in a single sintering treatment.

2. A method of manufacturing a permanent magnet as claimed in claim 1, wherein at least one of the elements Nd and Dy are used as the rare earth metal (RE).

3. A method of manufacturing a permanent magnet as claimed in claim 1, wherein the sintering treatment lasts maximally ten minutes.

4. A method of manufacturing a permanent magnet as claimed in claim 1, wherein the sintering treatment lasts maximally five minutes.

5. A method of manufacturing a permanent magnet as claimed in claim 1, wherein the sintering treatment lasts minimally two minutes.

6. A method as claimed in claim 1, wherein the sintering treatment lasts minimally 0.5 and maximally five minutes.

7. A method of manufacturing a permanent magnet as claimed in claims 1, wherein, in the case of sintering, the average warming-up rate exceeds 200 K/min.

8. A method of manufacturing a permanent magnet as claimed in claim 1 wherein the sintering treatment lasts from 0.5 to 10.0 minutes.

* * * * *